United States Patent [19]

Hübsch et al.

[11] 4,208,968

[45] Jun. 24, 1980

[54] PROJECTILE FOR PRACTICE AMMUNITION

[75] Inventors: Günter Hübsch, Kalchreuth; Rudolf Stahlmann, Fürth, both of Fed. Rep. of Germany

[73] Assignee: Dynamit Nobel AG, Troisdorf, Fed. Rep. of Germany

[21] Appl. No.: 821,249

[22] Filed: Aug. 2, 1977

[30] Foreign Application Priority Data

Sep. 4, 1976 [DE] Fed. Rep. of Germany ..... 2639884

[51] Int. Cl.[2] ..... F42B 11/18

[52] U.S. Cl. ..... 102/92.7; 102/41; 102/60

[58] Field of Search ..... 102/52, 60, 92.7, 41

[56] References Cited

U.S. PATENT DOCUMENTS

| | | | |
|---|---|---|---|
| 3,440,963 | 4/1969 | DeLuca | 102/92.7 |
| 3,731,630 | 5/1973 | Muller | 102/52 |
| 3,800,706 | 4/1974 | Gawlick et al. | 102/92.7 |

FOREIGN PATENT DOCUMENTS

| | | | |
|---|---|---|---|
| 753887 | 12/1970 | Belgium | 102/60 |
| 1187959 | 2/1965 | Fed. Rep. of Germany | 102/92.7 |
| 2301801 | 10/1976 | France | 102/92.7 |
| 1278021 | 6/1972 | United Kingdom . | |
| 1363495 | 8/1974 | United Kingdom . | |
| 1442072 | 7/1976 | United Kingdom | 102/92.7 |

*Primary Examiner*—Harold J. Tudor
*Attorney, Agent, or Firm*—Craig & Antonelli

[57] ABSTRACT

A projectile for training ammunition wherein the projectile body is joined at its front end to a dummy detonator. The dummy detonator is constructed as a hollow body and preferably a cap-shaped hollow body.

28 Claims, 6 Drawing Figures

PROJECTILE FOR PRACTICE AMMUNITION

Figure 1:
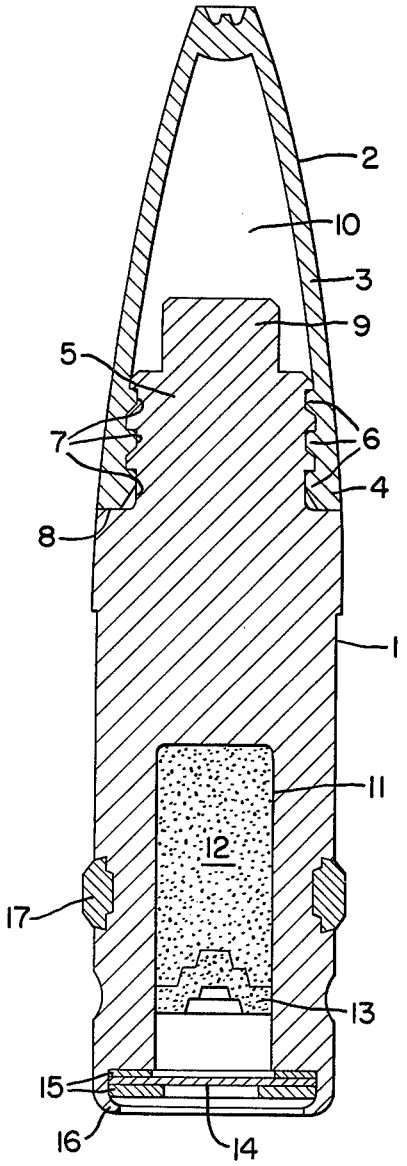

The present invention relates to a projectile for practice ammunition of the type having a projectile body joined at its front end with a dummy detonator and preferably being provided at its rear end with an axial recess for accommodating at least one pyrotechnical charge. A projectile for training purposes is known which is fired from a barrel closed off at the rear end. The body of the projectile which is made of metal, is provided at the front end with a dummy detonator joined form-fittingly thereto, the external shape of the dummy detonator corresponding to that of the detonator of a live shell. In this conventional projectile for training purposes, the dummy detonator is a solid, ogival body of aluminum threadedly inserted with its rear end in the projectile body of the live projectile. An axial bore which extends from the front end of this projectile body approximately over two-thirds of its length and which contains the explosive charge in case of the live shell, is filled in the training projectile with an inert filler or an inert packing, for example of aluminum.

This training projectile, based on a projectile body as provided in case of live ammunition, has at least about the same weight as the armed or live projectile. However, it has been found that, under practical conditions, the precision or target accuracy attainable with this training projectile is lower than that of a live shell.

Another disadvantage of the conventional training projectile is that a relatively high technical expenditure is necessary for its manufacture. That is, the solid, metallic dummy detonator must be provided at its rear end with a fine thread corresponding to that of the live detonator so that it can be threadedly inserted in the projectile body of the live ammunition. Additional, undesired expenditures are incurred due to the necessity of filling the forward bore of the projectile body with an inert material.

The present invention therefore has as an object the improving, in a training projectile of the type having a projectile body with a dummy detonator joined thereto at its front end and at its rear end preferably an axial recess of the blind hole type for accommodating at least one pyrotechnical charge, the flight characteristic and the target accuracy so that, during practice firing, maximum adaptation is obtained to the conditions existing when firing live ammunition. In this connection, the projectile is preferably provided with spin stabilization and the expenditures with respect to material and manufacturing process are to be at a minimum.

This objective is attained, in accordance with the invention, by the feature that the dummy detonator is constructed as a hollow body. The dummy detonator, consisting, for example, of steel, aluminum, or the like can be provided with a cylindrical, conical, ogival, annular, or similar bore emanating from the rear end of the dummy detonator and providing, in conjunction with the body of the projectile, such a weight distribution and center of gravity position of the entire training projectile that the required optimum characteristics with regard to external ballistics are obtained. That is, the training projectile exhibits the same target accuracy as in case of firing with live ammunition. Thus, the dummy detonator, fashioned as a hollow component, provides optimum adaptation to the respective conditions present in a particular case. In this connection, the body of the projectile utilized is no longer that of the live shell, but rather a training projectile body without the bore, provided for the explosive charge and subsequently to be refilled, and without the fine thread for the dummy detonator. This training projectile body can thus be manufactured with comparatively low cost and, in particular, also can be made of a material of lower strength than that of the live ammunition, whereby the machining of the article is substantially facilitated.

In a suitable embodiment of the invention, the dummy detonator is constructed as a cap-shaped hollow body. This ballistic cap has, in its essential zones, an approximately uniform, relatively minor wall thickness and makes it possible thereby to provide, if necessary, a further shift in the total center of gravity toward the rear of the projectile.

As has been found surprisingly, a lightweight dummy detonator of this kind, fashioned as a hollow body or cap, satisfactorily withstands the forces acting on the projectile during firing and during flight. The projectile is exposed, especially during firing, to very great forces, when it is being accelerated within a few milliseconds to such an extent that it exits from the barrel mouth at a velocity of about 1000 m/sec. or even higher velocities. In addition to the thus-incurred axial compressive forces, spin-stabilized projectiles, spinning at a number of revolutions of, for example, on the order of 100,000 r.p.m. upon exiting from the barrel, are furthermore exposed to strong radially acting centrifugal forces and additionally to corresponding tangential forces. The hollow or cap-shaped dummy detonator must not be unduly deformed or even damaged by these various forces, since in such an event the required, reproducible flight characteristic up to impingement in the target and thus the desired, improved target accuracy are no longer ensured. In case of spin-stabilized projectiles, the junction between the projectile body and the hollow or cap-shaped dummy detonator must furthermore be resistant to twisting so that the very rapid rotary motion enforced on the projectile body while passing through the barrel of the firearm is flawlessly transmitted to the dummy detonator, so that the latter does not exhibit any slippage with respect to the body of the projectile.

In accordance with a further feature of the present invention, the dummy detonator is made of a synthetic resin, especially a thermoplastic synthetic resin, so as to obtain, on the one hand, a further weight reduction and, on the other hand, in view of the elastic properties of the synthetic resin, a satisfactory dimensional stability of the hollow, particularly cap-shaped dummy detonator against external force effects, for example during transport, which could result in denting, and furthermore to attain a simple connection between the projectile body and the dummy detonator which yet flawlessly absorbs the occurring forces. In case of spin-stabilized training projectiles, the twist-resistant connection is of special importance, since otherwise, i.e. in case the dummy detonator does not fully participate in the rotation of the projectile body, the relative movements between the projectile body and the dummy detonator in the peripheral direction result in such a strong heating due to friction that the synthetic resin of the dummy detonator will begin to melt or even be consumed by melting, which is disadvantageous.

Basically, any type of synthetic resin can be used for the dummy detonator, as long as it withstands the occurring forces within the given temperature range. Examples of this connection are impact-resistant PVC, low-pressure polyethylene, or high-pressure polyethylene, optionally crosslinked, for example with carbon black and/or peroxides, polyesters, for example poly(-tetramethyleneterephthalate), or the like. Synthetic resins which can be easily processed in accordance with the injection-molding method or according to the press-molding process are preferred.

The connection between the body of the projectile and the dummy detonator can be effected in a great variety of ways. According to a particularly simple construction in accordance with this invention, the dummy detonator is provided with an extension which is inserted, for example, with a press-fit into a bore of the projectile body and wherein optionally an adhesive can be used in addition thereto. In order to absorb the axial forces, the dummy detonator rests with its rearward end face preferably on the forward end face of the projectile body. This supporting surface extends normally in a radial plane, but could also be arranged to be inclined. Preferably, the hollow space of the dummy detonator also extends over its extension, so that the latter has the shape of a sleeve. In addition thereto or in place thereof, the hollow space, however, could also be fashioned as an annular cavity within the dummy detonator, surrounding the extension.

According to another feature of the present invention, a form-fitting connection is provided between the two components by providing the extension of the dummy detonator with an annular bead and/or groove and a corresponding groove and/or bead in the core of the projectile body. Insofar as the dummy detonator and/or its extension is sufficiently elastic, the connection can be fashioned as a so-called snap lock. Otherwise, it is possible, for example, to radially press the projectile body, after insertion of the dummy detonator, against the extension by a subsequent sizing (calibrating) step to attain the form-fitting mating of the two components. Particularly in case of a dummy detonator made of a synthetic resin, it is advantageous, in order to obtain a high resistance against mutual twisting, to provide at least two snap-in grooves arranged in series in the axial direction.

In accordance with the present invention, another connecting arrangement can be obtained by joining the dummy detonator to the projectile body by friction, for example, by pressing the dummy detonator radially on the outside against a stem or projection of the projectile body and optionally can furthermore be glued thereto. Preferably, however, the dummy detonator according to this invention is pushed with press-fit onto the stem of the body of the projectile so that it is widened elastically in a corresponding manner in its rearward zone. However, the press-fit connection must not be too tight, to avoid damage, especially to dummy detonators of a synthetic resin, due to stress cracks during the generally required, very long storage time of, for example, ten years. In case of using high-pressure polyethylene as the synthetic resin for the dummy detonator, there is no danger of stress-crack formation, for example, if the permanent elongation exerted when pressing the dummy detonator onto the stem is smaller than about 3%. The dimensional stabilty of the dummy detonator is the greater, the larger its wall thickness. However, with an increasing wall thickness, the requirements posed regarding the twist resistance of the connection between the dummy detonator and the projectile body are, in turn, increased inasmuch as the mass of the dummy detonator to be set into rotation is enlarged. It has been found that the dummy detonator of this invention even satisfies these two mutually opposed requirements.

To keep the forces exerted by the projectile body on the dummy detonator in the peripheral direction, required for transmitting a certain torque, at a minimum, the present invention provides that the outer diameter of the stem of the projectile body is merely minimally smaller than the caliber of the projectile. The term "minimally smaller" means that the diameter difference between the caliber of the projectile and the outer diameter of the stem, half of which determines the wall thickness of the preferably cap-shaped dummy detonator in the rearward zone, is, if at all possible, selected to be no longer than required for the strength of the dummy detonator. Thus, the connecting area between the projectile body and the dummy detonator—as seen in the radial direction—is arranged maximally toward the outside. The arrangement according to the present invention which has proven to be particularly advantageous provides that the outer diameter of the stem is larger than 0.7 times and preferably 0.8 times the caliber of the projectile body.

The dummy detonator pushed with press-fit upon the lug-shaped stem of the projectile body can be additionally glued thereto, for example, with the aid of a suitable adhesive. However, instead, it is also possible to join both parts in the manner of a bayonet-catch lock. For spin-stabilized projectiles, this arrangement must be chosen so that the bayonnet lock is not released during firing.

In accordance with a further feature of this invention, the two components, in addition to being connected by a press-fit, are furthermore joined together form-fittingly, especially in a snap connection. The form-fitting connection is obtained by respectively providing the dummy detonator and the projectile body with at least one annular bead and a corresponding at least one annular groove which connection has the advantage over a bayonet catch that the two parts can be manufactured by a simpler procedure. If the material of the dummy detonator is so elastic that it participates in the temporary elastic expansion required for a snap lock, the assembly of the two parts is also greatly simplified thereby. A drying step as generally necessary with the use of adhesives is eliminated in case of the snap connection, which latter is preferred according to the invention. Preferably, the snap connection is fashioned with two or three series-arranged annular beads and/or grooves. To facilitate the placement of the dummy detonator onto the stem, it proves to be advantageous to fashion the annular beads of the stem and preferably also those of the dummy detonator on one side with a beveled annular surface so that the annular beads slide along one another when the two components are pushed axially over each other, thus imparting a correspondingly smaller radial expansion to the dummy detonator. In the snapped-in condition, the annular beads of the dummy detonator contact, with their other, preferably radially oriented annular surface, the corresponding, likewisely preferably radially oriented annular counter surface of the ring-shaped beads of the projectile body. In this connection, the material, particularly the synthetic resin, of the dummy detonator must be correspondingly elastic, so that this material can again yield radially toward the inside after the radial expansion during the snap-in of the annular beads into the corresponding annular grooves. The outer diameter of the stem is preferably that diameter indicated above and is dependent, in this connection, on the maximum outer diameter determined by the annular beads.

Particularly when fashioning the stem of the projectile body with radial projection for a form-fitting connection with the dummy detonator, a further reduction in manufacturing costs is made possible by constructing the stem separately from the projectile body and then firmly connecting the components. It is possible thereby to make the stem per se, for example, of a material of a lower strength than the body of the projectile whereby the working or machining expenditure for the stem is reduced. To establish a firm connection, the stem can be pressed, for example, with an appropriate axial lug into an associated bore of the projectile body, thus providing a press-fit. However, a connection obtained by providing the stem with a threaded pin which engages a corresponding threaded bore of the projectile body is preferred.

To provide a further influence on the center of gravity position of the training projectile with a predetermined constant total weight, the stem is provided with an axial recess of the blind hole type and/or an additional axial projection extending with a radial play into the dummy detonator which has proven to be an advantageous arrangement, whereby the mass distribution can be predetermined within relatively wide limits in correspondence with the requirements of the respective type of projectile. The bore and/or the projection are preferably of a cylindrical shape, but they can also be conical or tapered or can have any other, suitable configuration. These features make it possible in an advantageous manner, in conjunction with the dummy detonator of this invention, to fix the values for center of gravity position and weight of training projectile required for the target accuracy. In some cases, it is furthermore necessary to consider the effect of an axial recess of the blind bore type, emanating from the rear end of the body of the projectile, to accommodate a flare charge, a smoke charge, or the like, since also the size of such recess and the at least one pyrotechnical charge which may be housed therein affect the mass distribution of the entire training projectile and thus must be taken into account for the desired, optimum external-ballistics characteristic of the training projectile according to the invention. In accordance with another possibility for influencing the mass distribution, an additional composition such as a cylindrical rod, bar, pin, or the like, made of a material heavier or having a higher density as compared to the material of the remaining projectile body, preferably lead, can be inserted, for example, in the forward end of the projectile body such as in the bore of the stem and optionally extends with a radial clearance into the dummy detonator.

An additional increase of the strength of the connection between the projectile body and the dummy detonator can be achieved, if necessary, by providing that at least a portion of the contact surface between the dummy detonator and the projectile body is roughened. This roughening, which increases friction between the two parts, can be provided, for example, just by phosphating a metallic projectile body. However, it is also possible instead to fashion the contacting surface areas at least in part with a knurled surface. This knurling can be fashioned, for example, with a sawtooth configuration, inclined in case of spin-stabilized projectiles preferably in opposition to the spinning direction thereof. Suitably, in case of such an extensive roughening of the contact surfaces, an additional sizing step is provided after joining the two parts, so that the latter are pressed together and the materials enters the indentations of the knurled surface with a corresponding plastic deformation.

The projectile body of the training projectile of this invention is fashioned, including the optionally provided stem and axial projection, generally as an integral, solid body, particularly of metal. However, in certain cases—as indicated hereinabove—the stem together with the optionally provided axial projection can also be manufactured separately. Steel is preferably used as the metal. However, other metals such as soft iron, brass, or the like can be utilized. In dependence on the requirements to be met by the respective training ammunition, it is furthermore basically possible to produce the projectile body also of materials other than metals, such as, for example, synthetic resins, optionally with fillers of a higher density such as quartz powder, iron powder, or the like, ceramic material, etc. In this connection, it has proven to be advantageous to use, for the body of the training projectile according to this invention, a material of a lower strength than is used for the live shell, for example a material which can be more readily machined by a cutting process. This projectile body which can be manufactured in a simple manner is optionally subjected furthermore to an aftertreatment, e.g. a phosphating step, and, if necessary, subsequently coated with varnishes known for such purposes.

In a projectile body of soft iron, low-strength brass, or also other low-strength materials, it is possible that, when the flare charge, noise-producing charge, smoke charge, incendiary charge, or the like is directly pressed into the rearward bore of the projectile body, portions of the charge are uncontrollably forced into the wall of the projectile bore due to the necessary, high pressure exerted, and thus irregularities are encountered when manufacturing the projectile and when the charge is burning up. To avoid these disadvantages, in accordance with a feature of the present invention, at least one pyrotechnical charge, especially a flare charge, is pressed into a separate, thin-walled but yet dimensionally rigid sleeve with a sealed bottom, for example of steel, with the sleeve thus being inserted in the rearward bore of the projectile body with a friction fit. In order to seal and simultaneously provide this sleeve with an additional mounting within the projectile body, the sleeve is provided with a preferably radially oriented flange at its rear end, the rearward rim of the projectile body being flanged over against such flange with the interposition of a cover sealing the pyrotechnical charge against the atmosphere.

Figure 2:
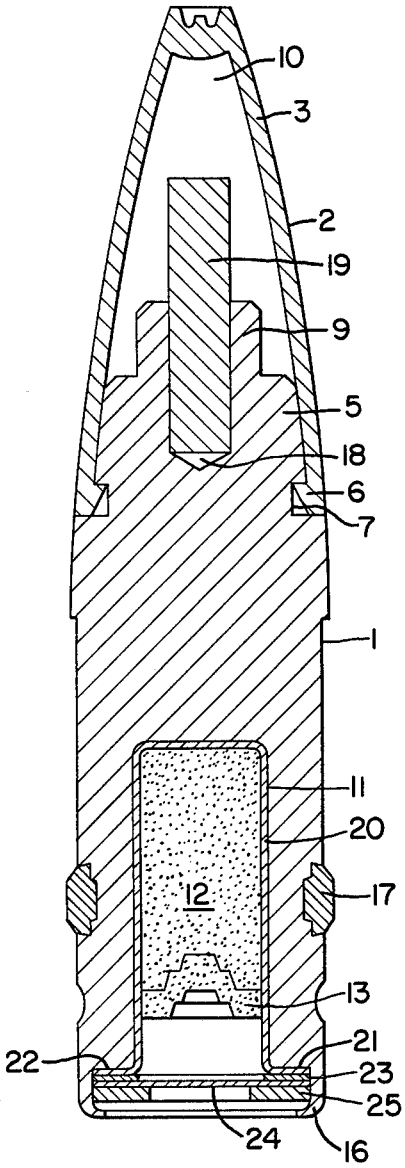
Figure 3:
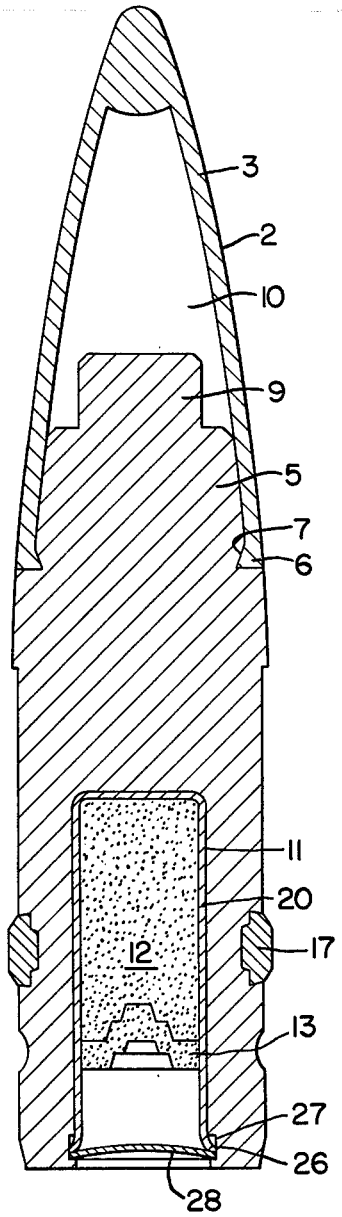
Figure 4:
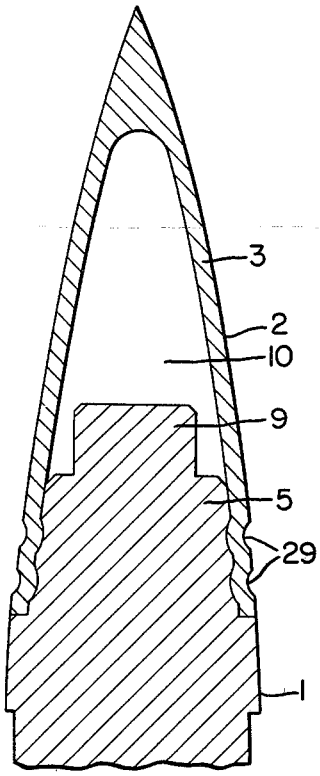
Figure 5:
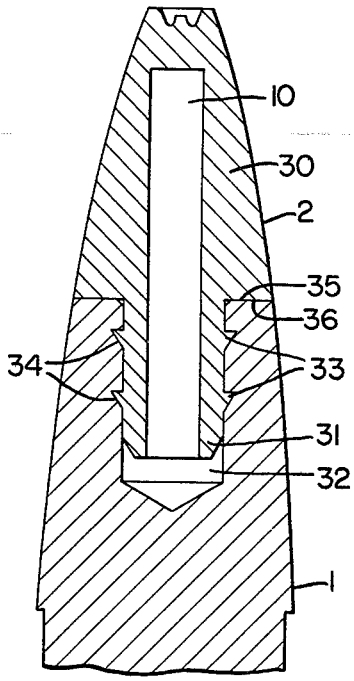
Figure 6:
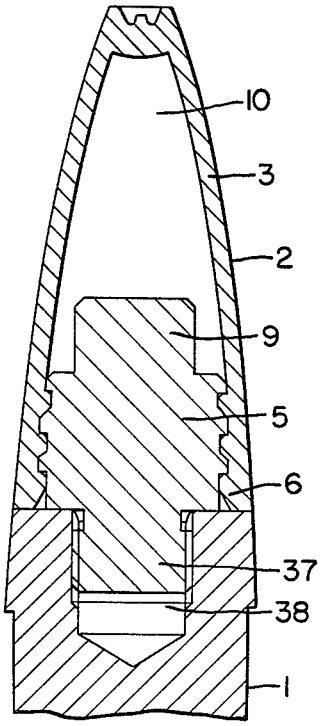

These and further objects, features and advantages of the present invention will become more obvious from the following description when taken in connection with the accompanying drawings which show, for purposes of illustration only, several embodiments in accordance with the present invention; and wherein FIGS. 1–3 illustrate different embodiments of the entire training projectile in accordance with the present invention; and FIGS. 4–6 show different embodiments of the forward end of the training projectile including the dummy detonator in accordance with the present invention.

Referring now to the drawings wherein like reference numerals are utilized to designate like parts throughout the several views, there is shown in FIG. 1, a projectile body 1, made for example of steel, connected to a dummy detonator 2 made, for example, of high-pressure polyethylene, constructed in this case as a cap-shaped hollow body 3. The connection is established by the rearward zone 4 of the dummy detonator extending with a press-fit over the outside of a lug-shaped stem 5 arranged at the front end of the projectile body 1. A form-fitting snap lock is additionally provided by the feature that the dummy detonator 2 extends with three annular beads 6 into corresponding annular grooves 7 of the stem 5. The dummy detonator 2 rests with its rearward end face on the shoulder 8 of the projectile body 1. As illustrated, the stem 5 is provided at its front end with an axial, cylindrical projection 9 extending into the hollow space 10 of the dummy detonator 2. The outside diameter of the stem 5 is preferably minimally smaller than the caliber of the projectile. That is, the diameter is of such size that the wall thickness of the portion of the dummy diameter extending over the stem is no larger than that required for strength of dummy detonator and together correspond to the caliber of the projectile. It has been found particularly advantageous for the diameter of the stem to be larger than 0.7 times and preferably 0.8 times the caliber of the projectile. The dummy detonator 2 can optionally be equipped, to increase its dimensional stability, with, for example, four inner reinforcing ribs, not shown, arranged so that they are uniformly distributed along the circumference and extend in the longitudinal direction.

The projectile body 1 furthermore has a bore 11 shaped like a blind hole, emanating from its rear end. A flare charge 12 and its combustible igniting composition 13 are housed in this bore, the latter being sealed toward the rear by means of a cover 14, made of paper, for example, which can be penetrated by an ignition jet and which is held between two annular disks 15 and a flanged-over rim 16. In the rear zone of the body of the projectile 1, a guide strip 17 of preferably sintered iron is arranged.

The individual cavities, especially that of the dummy detonator 2, are dimensioned in consideration of the varying mass densities, so that the training projectile is provided with almost the same weight as the live shell and has such a center of gravity position that it exhibits practically the same precision as the live ammunition. In this connection, the center of gravity in case of a training projectile of this invention fired under practical conditions is closer by about 10% to the tail of the projectile than in case of the comparable, conventional training projectile. Additionally, the ratio of length to diameter corresponding to the given caliber is more favorable in the training projectile of the present invention than in case of the known projectile, which likewise results in an improvement of the external ballistics characteristic.

In the training projectile shown in FIG. 2, the projectile body 1, made for example, of soft iron, is joined to the dummy detonator 2, which is again constructed as a ballistic cap 3 of a synthetic resin, by extending the rear portion of the dummy detonator over the stem 5 on the outside with a press-fit. The dummy detonator is provided with a single annular bead 6 which is snapped into the single annular groove 7 of the projectile body to provide a form-fitting connection. To additionally influence the center of gravity position, the stem 5 is provided, in this embodiment, with the projection 9 as well as a further axial recess 18 shaped like a blind hole, in which a cylindrical pin 19 of lead, for example, is inserted, this pin freely projecting with its front end into the cavity 10 with a radial clearance so as to influence the center of gravity position.

The flare charge 12 with the ignition composition 13 are pressed into a dimensionally rigid sleeve 20 of steel, for example, this sleeve being inserted in the bore 11 with a sliding fit. An annular radially directed flange 21 of the sleeve 20 contacts the rearward end face 22 of the projectile body 1 and is held with the interposition of an annular disk 23 of, for example, polyethylene, a cover 24 of a thin brass foil, for example, and an annular disk 25 of steel, for example, by means of the flanged-over rearward rim 16 of the projectile body 1 and is thereby sealed gastight.

The training projectile shown in FIG. 3 differs from the one shown in FIG. 2 essentially by the omission of the lead insert 19 and by a simplified arrangement of the flare charge, which is usable, for example, if the shelf life requirements are less strict. In this arrangement, the sleeve 20 is pressed with its rearward rim 26 into the annular groove 27 of the projectile body 1 and sealed off by means of the cover 28 of, for example, varnish-coated paper, synthetic resin sheet, or the like.

FIG. 4 shows a ballistic cap 3 of steel or aluminum, for example, which is held together with the projectile body 1 by means of the form-fitting connections 29 produced by corrugations.

FIG. 5 shows a dummy detonator 2 made of a synthetic resin by the injection molding method. This component is constructed as a hollow body 30 with a cavity 10 and engages with its sleeve-like axial extension 31 into a corresponding blind-hole-type recess 32 of the body 1 of the projectile. Thus, the dummy detonator is connected to the projectile body by way of at least two annular beads 33 engaging the corresponding annular grooves 34 of the projectile body in the manner of a snap connection. The rearward end face 35 of the dummy detonator 2 contacts the forward end face 36 of the projectile body 1.

In the variation of the present invention shown in FIG. 6, the stem 5 with the projection 9 formed of, for example, free-cutting brass or aluminum, is manufactured separately from the remainder of the projectile body 1, made of steel, for example, to simplify production. These two parts are joined together by way of a threaded pin 37 of the stem 5 engaging a threaded bore 38 of the projectile body.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. A projectile for training ammunition comprising an elongated projectile body means having a front end portion and a rear end portion, and dummy detonator means constructed as a hollow body with substantially longitudinally extending thin walls, the dummy detonator means being joined to the front end portion of the projectile body means, the dummy detonator means being formed of a synthetic resin and remaining firmly joined to the projectile body means means throughout the flight path of the projectile upon firing while exhibiting substantially no change in shape during firing and during flight so that the projectile exhibits a flight characteristic and target accuracy of a corresponding live ammunition, the projectile body means being provided with a forwardly directed lug-shaped stem member having an outer diameter smaller than the caliber of the projectile and larger than 0.7 times the caliber of the projectile, at least a portion of the thin walls of the dummy detonator means extending over the outside surface of the lug-shaped stem member.

2. A projectile according to claim 1, wherein the dummy detonator means is constructed as a cap-shaped hollow body.

3. A projectile according to claim 2, wherein the cap-shaped hollow body of the dummy detonator means forms the forward portion of the projectile and delimits a cavity therein.

4. A projectile according to claim 3, wherein the projectile body means is provided with an axial blind bore emanating from the rear end of the projectile body means for accommodating at least one pyrotechnical charge therein.

5. A projectile according to claim 4, further comprising a sleeve member with a closed front end portion disposed in the rearward axial blind bore of the projectile body means, and at least one pyrotechnical charge means being pressed into the sleeve.

6. A projectile according to claim 3, further comprising a sleeve member with a closed front end portion disposed in the rearward axial blind bore of the projectile body means, and at least one pyrotechnical charge means being pressed into the sleeve.

7. A projectile according to claim 1, wherein the projectile body means is provided with an axial blind bore emanating from the rear end of the projectile body means for accommodating at least one pyrotechnical charge therein.

8. A projectile according to claim 1, wherein at least one of the rearward portions of the dummy detonator means and the outside surface of the lug-shaped stem member is provided with at least one of at least one annular bead and annular groove for engaging with at least one of at least one corresponding annular groove and annular bead provided in the other of the outside surface of the lug-shaped stem member and the rearward portion of the dummy detonator means so as to provide engagement in a form-fitting manner.

9. A projectile for training ammunition comprising an elongated projectile body means having a front end portion and a rear end portion, and dummy detonator means constructed as a hollow body with substantially longitudinally extending thin walls, the dummy detonator means being joined to the front end portion of the projectile body means, the dummy detonator means being formed of a synthetic resin and remaining firmly joined to the projectile body means throughout the flight path of the projectile upon firing while exhibiting substantially no change in shape during firing and during flight so that the projectile exhibits a flight characteristic and target accuracy of a corresponding live ammunition, the projectile body means being provided with a forwardly directed lug-shaped stem member, the dummy detonator extending with at least the rear end portion thereof over the outside surface of the lug-shaped stem member and firmly engaging therewith, at least one of the rearward portions of the dummy detonator means and the outside surface of the lug-shaped stem member being provided with at least one of at least one annular bead and annular groove for engaging with at least one of at least one corresponding annular groove and annular bead provided in the other of the outside surface of the lug-shaped stem member and the rearward portion of the dummy detonator means so as to provide engagement in a form-fitting manner.

10. A projectile according to claim 9, wherein the projectile body means and the joined dummy detonator means have substantially the same weight as live ammunition of the same caliber and provide external ballistics corresponding to live ammunition.

11. A projectile according to claim 10, wherein the projectile body means and the joined dummy detonator means are configured so as to provide a variable center of gravity position enabling external ballistics corresponding to live ammunition.

12. A projectile according to claim 9, wherein the projectile body means is provided with an axial blind bore emanating from the rear end of the projectile body means for accommodating at least one pyrotechnical charge therein.

13. A projectile according to claim 12, further comprising a sleeve member with a closed front end portion disposed in the rearward axial blind bore of the projectile body means, and at least one pyrotechnical charge means being pressed into the sleeve.

14. A projectile according to claim 13, wherein the pyrotechnical charge means includes a flare charge.

15. A projectile according to claim 13, wherein the sleeve is provided with a radially extending flange at the rear end thereof, the projectile body means having a rearward rim portion flanged over the flange of the sleeve, and a cover member for sealing the pyrotechnical charge means against the atmosphere being interposed therebetween.

16. A projectile according to claim 9 wherein the projectile body means and the dummy detonator means form a spin stabilized projectile.

17. A projectile according to claim 9, wherein the dummy detonator means is provided with a rearward end face, and the projectile body means is provided with a continuous shoulder adjacent the lug-shaped stem member, the rearward end face of the dummy detonator means being in contact with the continuous shoulder.

18. A projectile according to claim 17, wherein the lug-shaped stem member is provided with an outer diameter smaller than the caliber of the projectile and larger than 0.7 times the caliber of the projectile.

19. A projectile according to claim 18, wherein the outer diameter of the stem member is approximately 0.8 times the caliber of the projectile.

20. A projectile according to claim 9, wherein the dummy detonator means and the lug-shaped stem member engage in the manner of a snap connection.

21. A projectile according to claim 9, wherein the projectile body means includes a projectile body member and the lug-shaped stem member, the projectile body member and the lug-shaped stem member being separately manufactured components and firmly connected to one another.

22. A projectile according to claim 21 wherein the projectile body member is provided with a threaded bore at the front end portion thereof and the lug-shaped stem member is provided with a rearwardly directed threaded pin engaging the threaded bore of the projectile body member.

23. A projectile according to claim 9, wherein the dummy detonator means and the projectile body means have surface portions in contact with one another, at least a portion of the contact surface between the dummy detonator means and the projectile body means being a roughened surface.

24. A projectile according to claim 9, wherein the projectile body means is a substantially solid body member.

25. A projectile according to claim 24, wherein the lug-shaped stem member is integral with the substantially solid body member.

26. A projectile for training ammunition comprising an elongated projectile body means having a front end portion and a rear end portion, and dummy detonator means constructed as a hollow body with substantially longitudinally extending thin walls, the dummy detonator means being joined to the front end portion of the projectile body means, the dummy detonator means being formed of a synthetic resin and remaining firmly joined to the projectile body means throughout the flight path of the projectile upon firing while exhibiting substantially no change in shape during firing and during flight so that the projectile exhibits a flight characteristic and target accuracy of a corresponding live ammunition, the projectile body means being provided with a forwardly directed lug-shaped stem member, the dummy detonator extending with at least the rear end portion thereof over the outside surface of the lug-shaped stem member and firmly engaging therewith, the lug-shaped stem member being provided with at least one of an axial blind bore at the front portion thereof and an additional axial projection member extending into the hollow body of the dummy detonator means with a radial clearance therefrom.

27. A projectile according to claim 26, further comprising an additional composition means disposed within the axial blind bore of the lug-shaped stem member, the composition means having a density higher than the density of the material forming at least the projectile body means.

28. A projectile according to claim 27, wherein the composition means extends into the hollow body of the dummy detonator means with a radial clearance therefrom.

* * * * *